US006332225B1

(12) United States Patent
Casey

(10) Patent No.: US 6,332,225 B1
(45) Date of Patent: Dec. 25, 2001

(54) SWEAT BAND WITH DISPLAYER

(76) Inventor: Semaj Casey, 133 Highway 78 W., Jasper, AL (US) 35501

( * ) Notice: Subject to any disclaimer, the term of this patent is extended or adjusted under 35 U.S.C. 154(b) by 0 days.

(21) Appl. No.: 09/597,164

(22) Filed: Jun. 20, 2000

(51) Int. Cl.[7] ..... A41F 9/00
(52) U.S. Cl. ..... 2/311; 2/171
(58) Field of Search ..... 2/1, 338, 311, 2/312, 170, 171, 174, 209, DIG. 11, 181, 184, 16, 22, 24, 455, 313–318, 326, 62, 910; D2/610, 614, 627; D11/4, 6; 40/586

(56) References Cited

U.S. PATENT DOCUMENTS

| | | | | |
|---|---|---|---|---|
| D. 205,327 | | 7/1966 | Lukas . | |
| D. 317,274 | | 6/1991 | Redina . | |
| D. 320,307 | | 10/1991 | Walasek . | |
| D. 356,648 | | 3/1995 | Abatiell et al. . | |
| D. 370,111 | * | 5/1996 | Walker | D2/610 |
| D. 414,715 | | 10/1999 | Visser . | |
| 3,290,707 | | 12/1966 | Montgomery . | |
| 4,060,185 | | 11/1977 | Kuroda . | |
| 4,164,910 | * | 8/1979 | Feiler | 40/586 |
| 4,918,758 | | 4/1990 | Rendina . | |
| 5,642,739 | | 7/1997 | Fareed . | |
| 5,704,067 | * | 1/1998 | Brady | 40/586 |
| 5,762,619 | * | 6/1998 | Simon | 2/312 |
| 5,802,608 | | 9/1998 | Earl . | |
| 5,816,952 | | 10/1998 | Blevins . | |
| 5,823,012 | | 10/1998 | Hacskaylo . | |
| 5,826,277 | | 10/1998 | McConville . | |
| 5,901,370 | * | 5/1999 | Linday | 2/171.1 |
| 5,901,379 | | 5/1999 | Harata . | |
| 5,915,532 | * | 6/1999 | Williams | 2/171 |
| 5,920,901 | * | 7/1999 | Tollini | 2/22 |
| 5,970,526 | * | 10/1999 | Weathrs | 2/321 |
| 6,085,449 | | 7/2000 | Tsui . | |
| 6,099,490 | * | 8/2000 | Turtzo | 2/311 |

OTHER PUBLICATIONS

29/125,195, filed Jun. 20, 2000, Casey.

* cited by examiner

*Primary Examiner*—John J. Calvert
*Assistant Examiner*—Tejash Patel
(74) *Attorney, Agent, or Firm*—Law Office of David G.; Kerry S. Culpepper

(57) ABSTRACT

An article for wearing that is elastic and sweat absorbing that displays information over a particular shape.

20 Claims, 4 Drawing Sheets

SWEAT BAND WITH DISPLAYER

CROSS REFERENCE TO RELATED APPLICATIONS

Not Applicable

STATEMENT REGARDING FEDERALLY SPONSORED RESEARCH

Not Applicable

BACKGROUND OF THE INVENTION (1) Field of the Invention

The invention relates to garments that are worn that provide sweat relief, display useful information and have a tight fit by means of an elastic connection.

(2) Description of the Related Art

Sweat bands in general have been known in the sports environment for years. In sports, for example, athletes have been known to wear different color head bands or arm bands in order to display their individuality, or demonstrate style. Many of these different sweat bands are the same color as the player's team color, however, there is an absence of sweat bands designed to display useful information, such as the player's jersey number, a particular product that they desire to endorse, or a political message.

U.S. Pat. No. 5,802,608 to Earl discloses a waistband with an elastic belt for identifying athletes during sports events. However, the invention of Earl is designed for the waist in particular, and the display portion hangs loosely from the elastic belt rather than being secured by elastic means on both sides. The displaying portion could easily be torn off. In addition, the displaying means used in Earl is not consistent with the current style of athletes.

U.S. Pat. No. 5,901,379, to Harata discloses a sweat band that wraps around the arm. However, it is connected by a fastener, rather than by elastic means, and does not include any display means.

U.S. Pat. No. 5,823,012 to Hacskaylo discloses an athletic band, however, the displaying means are integrated on the band, and not connected to the band by elastic means.

U.S. Pat. No. 4,918,758 to Rendina discloses a stretch band with display means. However, the display means are removably attached to the stretch band by Velcro® rather than by elastic means.

U.S. Pat. No. 5,826,277 to McConville also discloses a stretch band with display means. However, the display means are directly stitched upon the band rather than being connected by elastic means.

BRIEF SUMMARY OF THE INVENTION

This invention relates to a sweat band, and a displayer that is attached by elastic means to the sweat band. The sweat band, the elastic means, and the displayer can be made from the same materials. The elastic means provides for a tight fit on the body, and a tight connection between the sweat band portion and the display portion. The elastic means can be made from any elastic material. The garment can be designed and worn for any portion of the body, but the preferred use is for the arm. The displayer and the sweat band are made of any common perspirant-absorbing materials. For example nylon, cotton, or spandex would suffice. The displayer has information attached to it, such as a player's number. This information can be attached to the displayer by any convention means, such as stitching, or by Velcroe (registered trademark). The information could also be designed so as to be integrated to the displayer. The elastic means, sweat band and displayer can be designed in different stylish shapes, however they will still serve the same functional purpose.

DETAILED DESCRIPTION OF THE INVENTION

Figure 1:
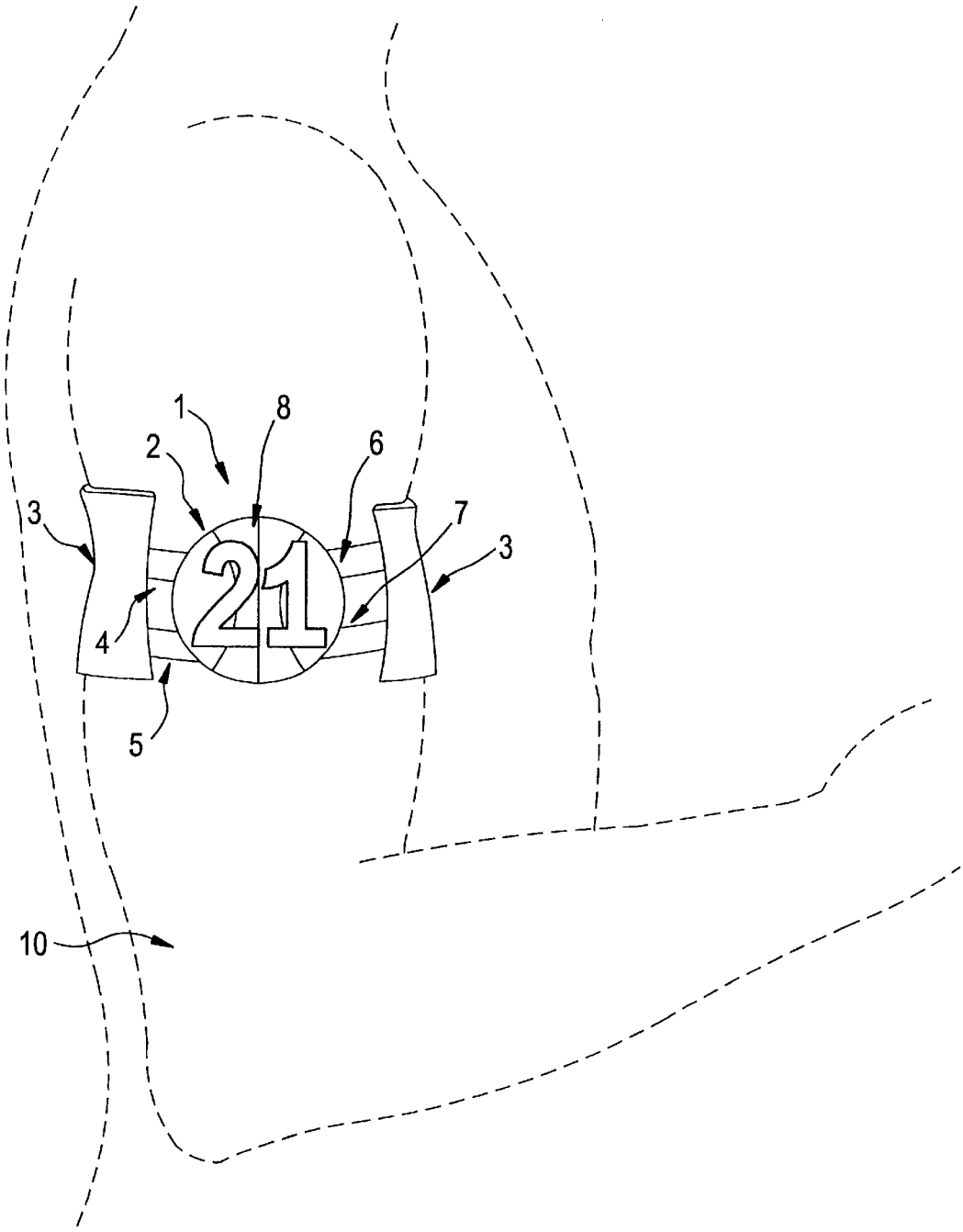
FIG. 1 is an front elevation view of a first embodiment of the invention shown in its operating environment.
Figure 2:
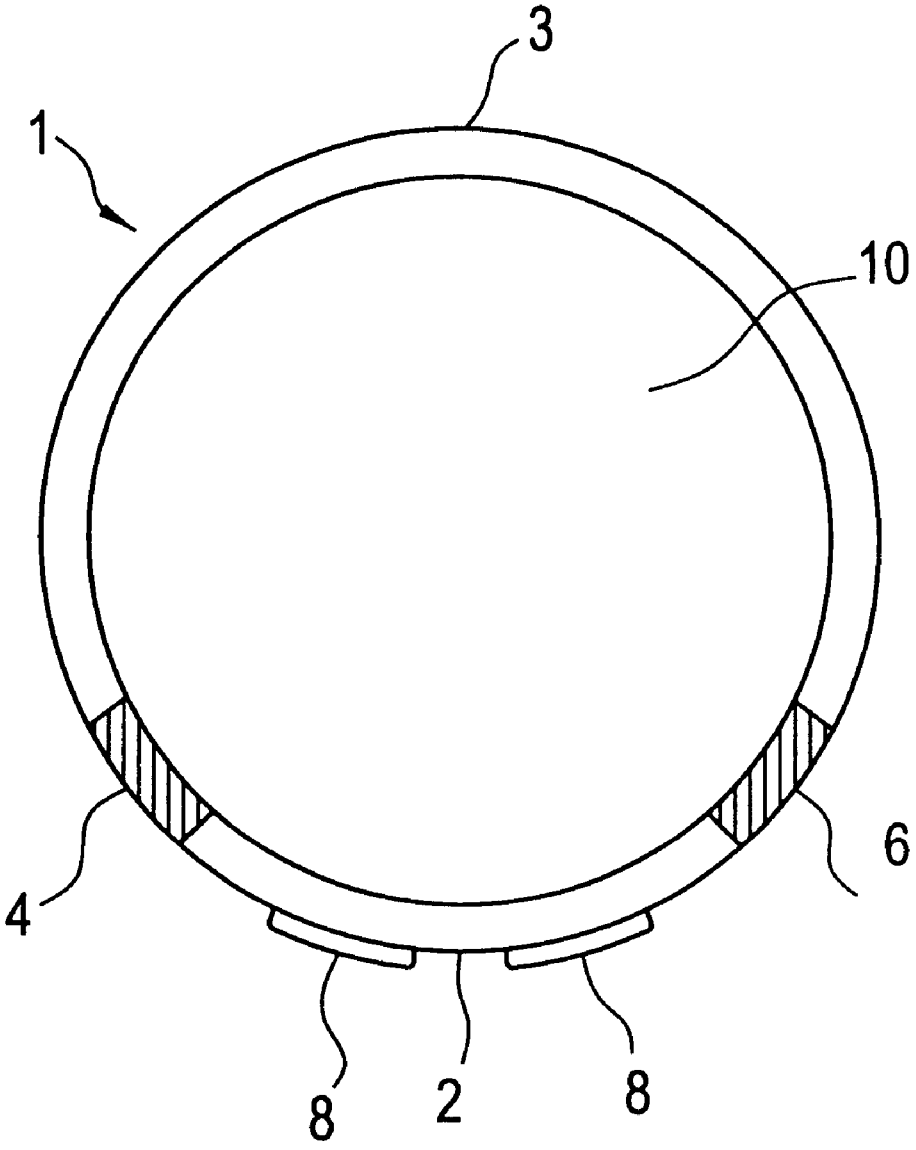
FIG. 2 is a top view of the garment shown in FIG. 1.
Figure 4:
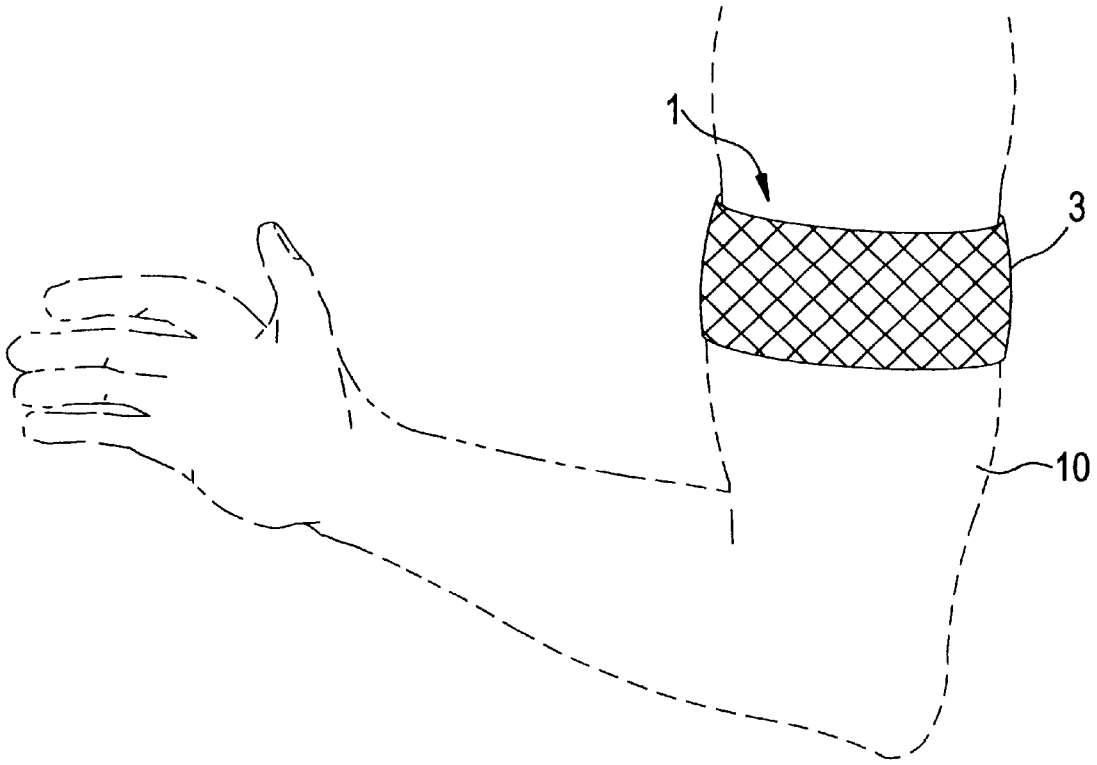
FIG. 4 is a rear elevation view of the first and second embodiments of the invention shown in its operating environment.

A first embodiment of the invention is illustrated by FIGS. 1–2, and 4. The invention is referred to generally by 1 is worn on a human arm 10. The displayer 2 displays the information 8 that is designed on the displayer. In this first embodiment, displayer 2 is designed as a basketball, and the information displayed 8 is the number twenty-one. However displayer 2 could be any design, and the information 8 could be any number, or any message or shape. There could optionally be no information 8 displayed. The information 8 could be attached to displayer 2 by stitching means, Velcro® means, glue means, or any known manner of attaching materials. The attachment could be releasable, by button means, or any other releasable connection means. The information 8 could also be designed to be integrated with the displayer 2 by using different color stitching for information 8 than is used for sweat band portion 3 when fabricating the invention 1. Any known means for designing garments that display a design integrally with the garment can be used. The displayer 2 and the sweat band portion 3 are made out of any perspiration absorbent material. The sweat band portion 3 can be any appropriate width or length. The elastic means are preferably four elastic strips 4–7 that arc preferably rectangular, and can be attached to the displayer and the sweat band by any suitable means, such as stitching. Any suitable number of elastic strips could be used. Alternatively, the elastic strips 4–7 could be integrally designed with the sweat band portion 3, and displayer 2, rather than being separate. In this design, elastic strips 4–7, and displayer 2 could be made by cutting it out from a complete tubular sweat band.

A top view of the invention 1 is shown in FIG. 2. The top view shows that the information 8 protrudes a small amount from the displayer 2. However, in a possible alternative embodiment where information 8 is integrated to displayer 2, information 8 would not protrude from displayer 2.

Figure 3:
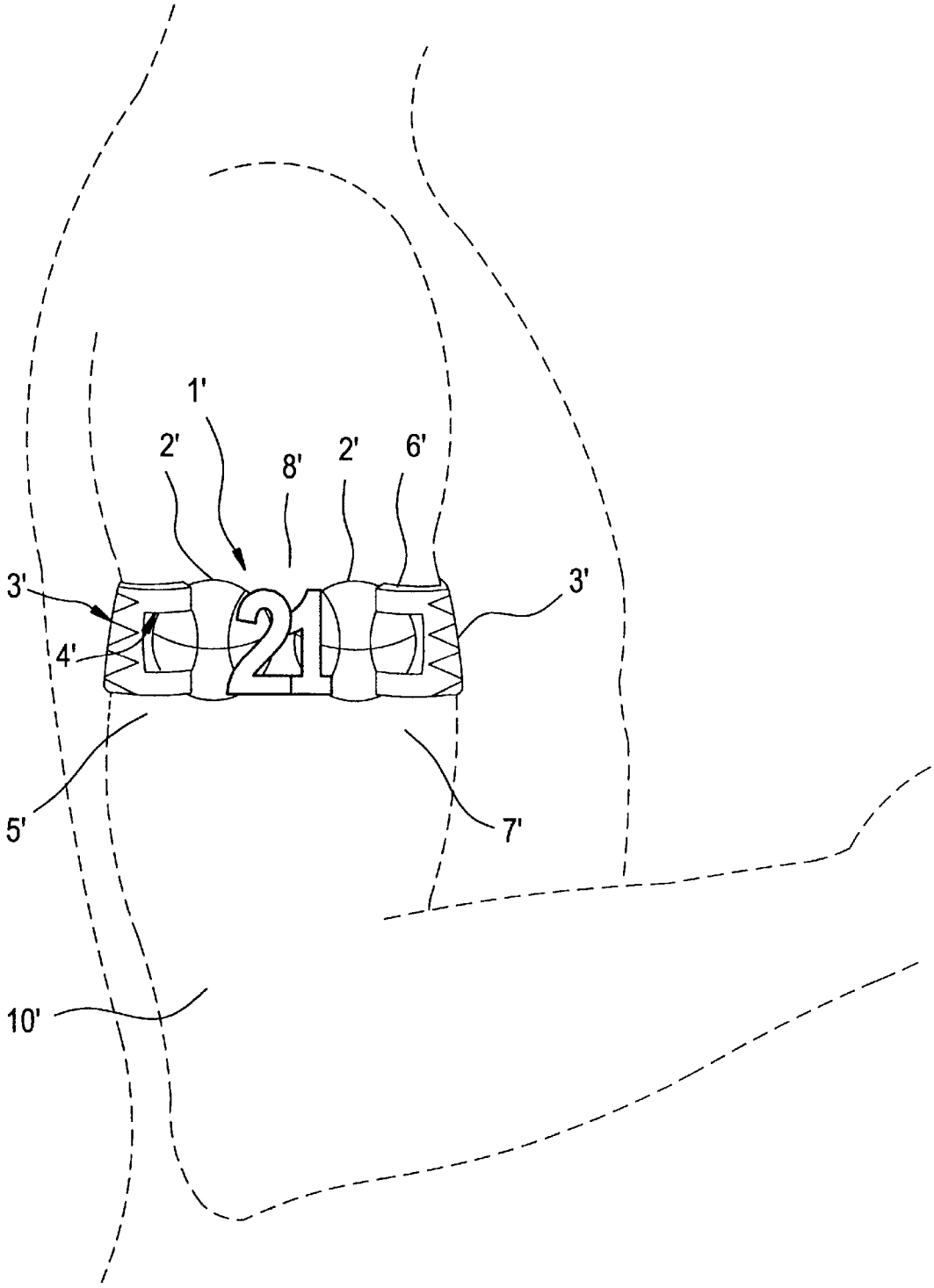
FIG. 3 is an front elevation view of a second embodiment of the invention shown in its operating environment.

FIG. 3 illustrates a second embodiment of the invention. In this embodiment, the displayer 2' comprises two basketballs (or any particular shapes) that are attached to each other and to sweat band portion 3', by any suitable means.

FIG. 4 illustrates a a rear elevation view of the first and second embodiments of the invention 1 being worn on arm 10 of user. The rear section of the invention 1 is simply the sweat band portion 3.

In use, the present invention 1 is put onto the arm, head, leg, or whichever portion of the body where it is desired to be placed. The individual need only stretch the invention over that particular portion of the body. The elastic material of the invention provides for a tight fit, and the displayer 2 displays useful information with a stylish look.

Although the present invention has been described with reference to preferred embodiments, one skilled in this art may make numerous revision in form and detail, and such revisions are intended to fall within the scope of the following claims. For example, any of the connections could be releasable, rather then permanent. Also, the information 8 could be on both sides of the displayer 2, so that the invention would be reversible.

What is claimed is:

1. An article to be worn by an individual comprising:

a sweat band portion with two ends, elastic strips, a displayer portion, wherein said elastic strips connect said displayer portion with said sweat band portion at said two ends, and provide for a tight fit, and wherein said elastic strips, said displayer portion, and said sweat band portion form a complete continuous tubular member.

2. The article of claim 1, wherein said elastic strips are connected to said sweat band portion and said displayer portion by stitching means.

3. The article of claim 1, wherein said elastic strips are integrally connected to said sweat band portion and said displayer portion.

4. The article of claim 1, wherein said displayer portion displays information that is attached to said sweat band portion and said displayer portion.

5. The article of claim 1, wherein said elastic strips are of a smaller width then the width of the sweat band.

6. The article of claim 1, wherein said elastic strips are four in number.

7. The article of claim 1, wherein said sweat band is made of perspiration absorbent material.

8. The article of claim 7, wherein said displayer is made of perspiration absorbent material.

9. The article of claim 8, wherein said elastic strips are made of perspiration absorbent material.

10. The article of claim 1, wherein said elastic strips, and said sweat band portion are made of elastic material.

11. The article of claim 10, wherein said displayer is made of elastic material.

12. The article of claim 1, wherein said sweat band, said elastic strips, and said displayer portion are made of perspiration absorbent material and elastic material.

13. The article of claim 10, wherein said displayer portion is in a shape and design of a basketball.

14. The article of claim 10, wherein said displayer is in the shape and design of two basketballs.

15. The article of claim 1, wherein said displayer portion displays useful information that is integrally connected to said displayer portion.

16. An article to be worn by an individual comprising:

a sweat band portion made of perspiration absorbent material with two ends;

displaying portion means made of perspiration absorbent material for displaying useful information;

elastic means for connecting said displaying means with said sweat band portion at said two ends and for providing a tight fit.

17. The article of claim 16 wherein said elastic means are at least two in number and have a smaller width then the width of said sweat band portion.

18. The article of claim 16 where said useful information is connected to said displaying portion in a releasable connection.

19. An article that is worn by an individual comprising:

a sweat band portion consisting essentially of one member with two ends, a display portion comprised of one member, elastic strips connected to said sweat band portion at said two ends, wherein said elastic strips connecting said displayer with said sweat band portion, and wherein said elastic strips, said displayer portion, and said sweat band portion form a complete continuous tubular member.

20. The article of claim 19 wherein said elastic strips are four in number, arranged in sets of two, and parallel to each other within said sets.

* * * * *